US008469403B2

(12) United States Patent
Benit

(10) Patent No.: US 8,469,403 B2
(45) Date of Patent: Jun. 25, 2013

(54) DEVICE FOR MOUNTING AND CONNECTING SANITARY EQUIPMENT PIPES PROVIDED BEING A WALL AND CORRESPONDING METHOD

(76) Inventor: Claude Benit, Dammartin en Goele (FR)

( * ) Notice: Subject to any disclaimer, the term of this patent is extended or adjusted under 35 U.S.C. 154(b) by 234 days.

(21) Appl. No.: 12/864,135

(22) PCT Filed: Jan. 20, 2009

(86) PCT No.: PCT/FR2009/000058

§ 371 (c)(1),
(2), (4) Date: Oct. 18, 2010

(87) PCT Pub. No.: WO2009/106771

PCT Pub. Date: Sep. 3, 2009

(65) Prior Publication Data

US 2011/0025046 A1 Feb. 3, 2011

(30) Foreign Application Priority Data

Jan. 23, 2008 (FR) ..... 08 00339

(51) Int. Cl.
*F16L 3/00* (2006.01)

(52) U.S. Cl.
USPC ..... 285/64; 137/360

(58) Field of Classification Search
USPC ..... 137/360, 382; 285/46, 64
See application file for complete search history.

(56) References Cited

U.S. PATENT DOCUMENTS

| | | | | | |
|---|---|---|---|---|---|
| 1,115,696 | A | * | 11/1914 | Linbarger | 285/64 |
| 4,014,388 | A | * | 3/1977 | Anderson | 169/37 |
| 4,307,901 | A | * | 12/1981 | Orberg et al. | 285/3 |
| 4,410,004 | A | * | 10/1983 | Kifer et al. | 137/360 |
| 5,031,940 | A | * | 7/1991 | Stefanos | 285/45 |
| 5,351,996 | A | | 10/1994 | Martin | |
| 5,964,246 | A | * | 10/1999 | Meeker | 137/360 |
| 6,125,881 | A | * | 10/2000 | Hobbs et al. | 137/360 |
| 6,435,206 | B1 | * | 8/2002 | Minnick | 137/360 |
| 7,077,156 | B1 | * | 7/2006 | Humber et al. | 137/360 |
| 2005/0247347 | A1 | * | 11/2005 | McNerney | 137/360 |

FOREIGN PATENT DOCUMENTS

| | | | |
|---|---|---|---|
| CH | 635179 | A5 | 3/1983 |
| DE | 3310138 | A1 | 10/1984 |
| DE | 4032445 | A1 | 5/1991 |
| EP | 0166234 | A2 | 1/1986 |
| EP | 1348815 | A1 | 10/2003 |
| EP | 1533556 | A1 | 5/2005 |

* cited by examiner

*Primary Examiner* — Aaron Dunwoody
(74) *Attorney, Agent, or Firm* — Clark & Brody

(57) ABSTRACT

The invention relates to a device and a method for mounting and connecting at least one sanitary equipment pipe provided behind a wall, and to a corresponding method. The device includes at least one member for connection to a rear portion to be connected to a free end of the pipe, and a front portion including means for connection to another member of the sanitary equipment, provided in front of the wall, and at least one housing having an open face through which a connection member can be inserted and an opening for the passage of a free end of the pipe, characterized in that said housing further has an open face through which a connection member can be inserted, said housing being adapted to be inserted in a passage formed through said wall from the front of said wall and having means for attaching the same against the front face of said wall.

17 Claims, 3 Drawing Sheets

DEVICE FOR MOUNTING AND CONNECTING SANITARY EQUIPMENT PIPES PROVIDED BEING A WALL AND CORRESPONDING METHOD

FIELD OF THE INVENTION

The present invention relates to the field of, in particular domestic, water distribution installations or sanitary installations.

BACKGROUND OF PRIOR ART

It is known to fix a pipe fitting to a solid wall and to connect this pipe fitting to the end of a pipe running in front of this wall. The pipe is thus visible and takes up space.

Some walls of dwellings comprise a front partition and a rear partition which are separated from one another and between which one or more water pipes may be found for supplying a pipe fitting. Similarly, some heating installations distribute hot water through pipes placed under the floorboards.

Devices have thus been proposed for mounting and connecting at least one sanitary installation pipe installed behind a partition, such as the one described in the document EP-1 348 815.

Such a device comprises a connecting element having a rear part intended to be connected to a free end of the pipe and a front part having means for connecting to another element of the installation, such as a pipe fitting.

This device comprises a metal plate having a through-passage for the front part of the connecting element, this plate being fixed both to the front part of the connecting element and on the front side of the partition. Such a plate can also be designed for mounting and connecting a plurality of pipes.

Earthenware tiles can then be adhesively bonded to the front side of the partition, covering the plate.

Such a device has been satisfactory but has a number of drawbacks. In particular, it provides no means for positioning the plate on the partition and makes it difficult to position the connecting element with respect to the tiles. It is thus possible that the front part of the connecting element will not emerge at a joint between two earthenware tiles, leading to complicated cutting of the tiles. Furthermore, the means for fixing the plate require special tools which are expensive. Finally, handling the metal plate is difficult owing to its weight and the absence of any means for holding it against the partition before it is fixed.

SUMMARY OF THE INVENTION

It is an object of the invention to alleviate these drawbacks by providing a device for mounting and connecting at least one sanitary installation pipe provided behind a wall, this device being much easier to use, both as regards its constituent means and the tools which are necessary for installing it and the positioning of which can be adjusted easily and with precision, and having a lower cost.

This device for mounting and connecting comprises at least one connecting element having a rear part intended to be connected to a free end of the pipe and a front part having means for connecting to another element, provided in front of the wall, of the installation, and at least one housing which has an opening for a free end of the pipe to pass through, characterized in that said housing further has an open side through which a connecting element can be introduced, said housing being intended to be introduced into a passage provided through said wall from the front of the wall and having means for fixing it on the front side of said wall.

Preferably, said at least one housing comprises on its open side a collar intended to be pressed against the front side of said wall. In this case, the means for fixing the housing on the front side of the wall are provided on said collar.

Likewise preferably, the housing has a bottom on which sockets for fixing the connecting element are provided.

Moreover, the rear part of the connecting element advantageously has a rigid tubular end fitting, the free end of the pipe thus being fitted on said end fitting by means of a metal ring attached to the pipe and of a nut screwed onto said end fitting.

In this case, the ring is preferably machined in order to promote the flow of the material toward the inside of the ring when the nut is screwed onto the end fitting.

Preferably, the device according to the invention further comprises a cover for closing the open side of a housing.

In this case, the cover advantageously has a precut part for the front part of the connecting element to pass through and means for fixing it to the housing.

When the device according to the invention is intended for mounting and connecting two pipes intended for two inlets of said other element of the sanitary installation, the device advantageously comprises a template formed by two covers connected by a rod, the length of the rod corresponding to the spacing between the two inlets.

The device may be produced from plastic, in particular ABS.

The invention also relates to a method for mounting and connecting at least one sanitary installation pipe provided behind a wall, comprising the following steps:

(a) providing at least one through-passage in said wall;
(b) introducing the connecting element into a housing through the open side of the housing;
(c) passing the free end of the pipe through an opening provided in the housing;
(d) connecting the free end of the pipe and the rear part of the connecting element;
(e) introducing said housing into said passage from the front of the wall such that said open side opens onto the front side of the wall; and
(f) fixing the housing on the front side of the wall.

According to this method, it is preferable to fix the connecting element in the housing after step (d).

Advantageously, in the method, before step (f), the housing is pressed against the front side of said wall by way of a collar provided on its open side.

In this case, step (f) is carried out with fixing means provided on said collar.

Preferably, step (d) consists in attaching a metal ring around the free end of the pipe and in screwing a nut onto a rigid tubular end fitting provided on the rear part of the connecting element, the screwing operation causing axial compression of the ring and mechanically fastening the ring irreversibly to the duct.

In this case, the ring is preferably machined in order to promote the flow of the material toward the inside of the ring during screwing.

Advantageously, after step (f), the method according to the invention comprises an additional step which consists in closing the open side of the housing with a cover having a passage for the front part of the connecting element.

Finally, when the method is intended for mounting and connecting two pipes, it comprises another step which consists in defining the spacing between two passages in the partition by means of a template.

BRIEF DESCRIPTION OF THE DRAWINGS

The invention will be better understood and further aims, advantages and features thereof will become more clearly apparent from reading the following description which is given with reference to the attached drawings, which are given solely by way of nonlimiting examples and in which.

DESCRIPTION OF THE PREFERRED EMBODIMENTS OF THE INVENTION

The elements common to the various figures will be provided with the same reference signs.

Figure 1:
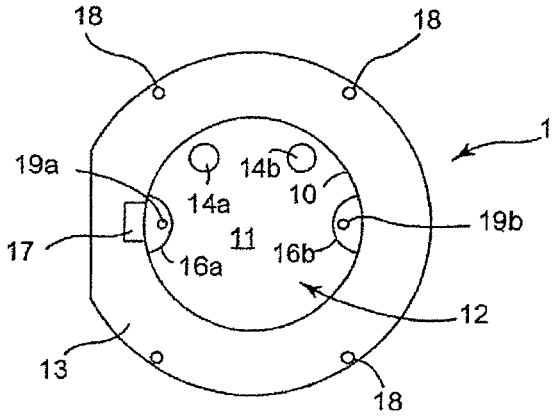
FIG. 1 shows a top view of a housing of a mounting and connecting device according to the invention.
Figure 2:
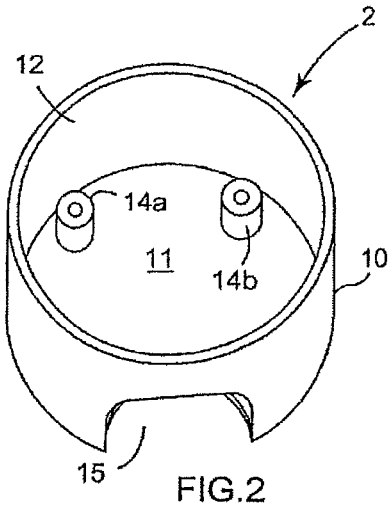
FIG. 2 is a perspective view of a variant embodiment of the housing illustrated in FIG. 1.

Reference is first of all made to FIGS. 1 and 2, which illustrate two variant embodiments of a housing of a mounting and connecting device according to the invention, which is intended, for example, to be fixed in a wall of a dwelling.

These housings 1, 2 have a cylindrical form with a wall 10, a bottom 11 and an open side 12 opposite the bottom 11.

The housing 1 has a collar 13, having in this example an annular form, which surrounds the open side 12 of the housing. The housing 2 illustrated in FIG. 2 does not have such a collar.

On the bottoms 11 of the housings 1 and 2 there are two sockets 14*a* and 14*b* which serve to fix the connecting element, as will be explained further below in the description.

In addition, the cylindrical wall 10 of the housings 1 and 2 has an opening 15 on the opposite side from the sockets 14*a* and 14*b*.

The housing 1 illustrated in FIG. 1 also has two elements 16*a* and 16*b* protruding into the cylindrical cavity of the housing. These elements 16*a* and 16*b* have orifices 19*a* and 19*b* which serve to fix a cover, as will be described further below in the description.

The housing illustrated in FIG. 1 also has a cutout which serves to position a template, as will be explained with reference to FIG. 6.

The housings illustrated in FIGS. 1 and 2 are produced in one piece and they are, in practice, similar to the housings used for electrical assemblies. In particular, these housings are preferably produced from plastic. The material used must be strong. It is for this reason that the housings can in particular be produced from ABS. These housings have a greatly reduced manufacturing cost.

These housings may for example have a diameter of around 65 mm.

Figure 3:
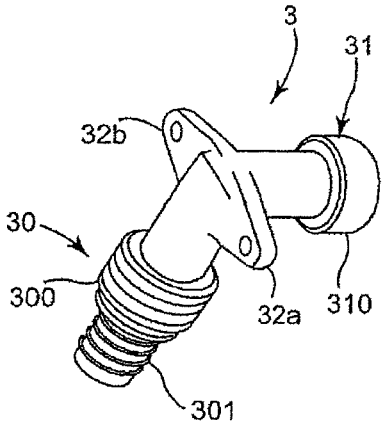
FIG. 3 is a perspective view of a connecting element of a mounting and connecting device according to the invention.

FIG. 3 illustrates an example of a connecting element that can be used for the device according to the invention.

This element 3 has a rear part 30 intended to be connected to a free end of a pipe and thus intended to remain behind the wall. The connecting element also has a front part 31 which, for its part, is intended to protrude from the front side of the wall.

The rear part 30 is designed such that the assembly method described in the patent EP-1 533 556 can be implemented.

Of course, other connections with the pipe of a sanitary installation can be provided without departing from the scope of the invention. However, this assembly method allows irreversible mechanical fastening and eliminates virtually any risk of a leak. This type of connection is thus particularly advantageous within the scope of the invention. This is because any leak that may occur will be difficult to detect and repairing it will involve significant work because the connection is located on the rear side of the wall and is thus not readily accessible.

The rear part 30 thus has a rigid tubular end fitting 300 which is threaded and onto which a nut is intended to be screwed. It also has an end 301 having a smaller diameter for connection to a pipe.

The end of the front part 31 of the connecting element has an end fitting 310 having an internal thread which will enable this front part to be connected to another element of the sanitary installation, such as a pipe fitting.

The connecting element also has two protruding parts 32*a* and 32*b* intended for fixing the connecting element to the sockets 14*a* and 14*b* illustrated in FIGS. 1 and 2.

Figure 4:
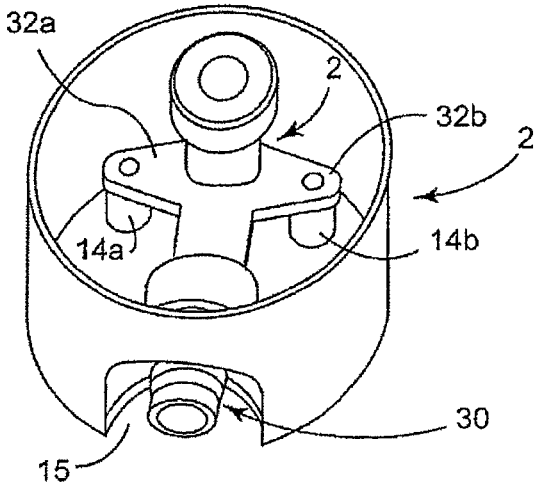
FIG. 4 is a perspective view of the connecting element illustrated in FIG. 3 after it has been fixed in the housing illustrated in FIG. 2.

FIG. 4 shows the connecting element 3 after it has been mounted and fixed in the housing 2.

The protruding elements 32*a* and 32*b* have been fixed by appropriate means on the sockets 14*a* and 14*b*, conventionally by screws.

The rear part 30 of the connecting element is thus located facing the opening 15 in the housing 2.

Figure 5:
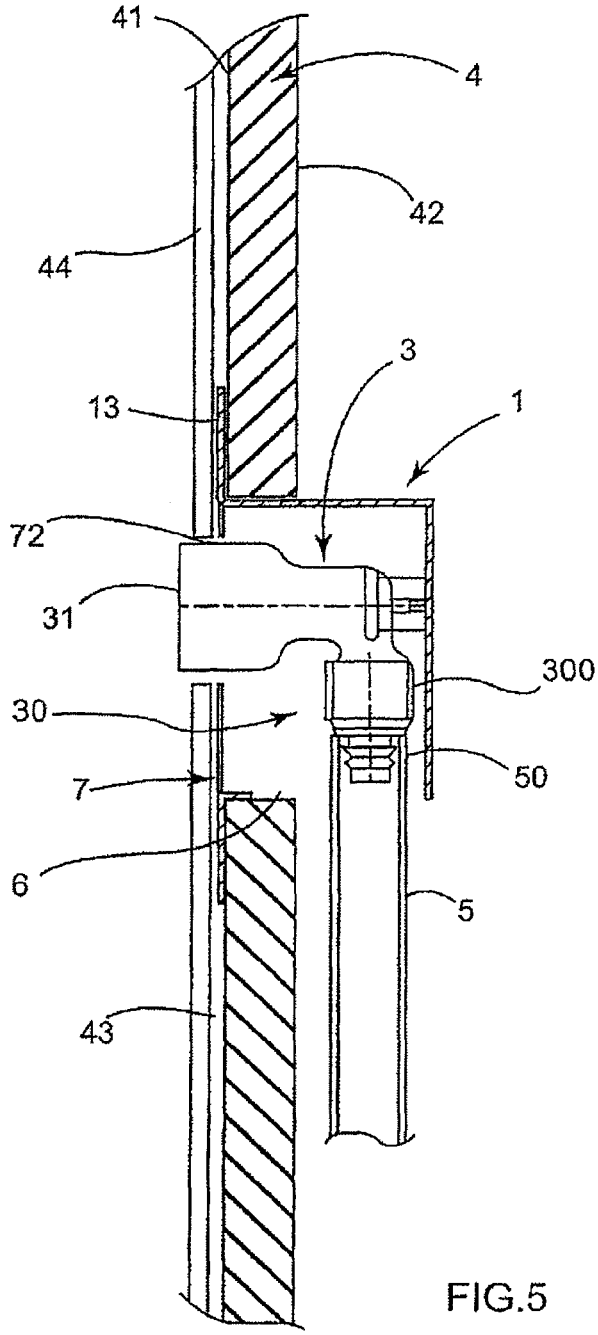
FIG. 5 is a schematic sectional view of a wall in which the mounting and connecting device according to the invention has been fixed.

Reference will now be made to FIG. 5 in order to describe the mounting and connecting method according to the invention and the use of the device which has just been described.

FIG. 5 illustrates a wall 4 having a front side 41 and a rear side 42. A water supply pipe extends on the rear side of the wall (on the right in FIG. 5), while another element of the sanitary installation, such as a pipe fitting, is located on the front side of the wall (on the left in FIG. 5).

This wall 4 may for example be a plasterboard panel fitted on a runner or else associated with another wall, there then being an empty space between the front wall 4 and the associated rear wall.

In all cases, a sanitary installation pipe 5 emerges from the ground and runs upward behind the wall 4.

This pipe 5 may in particular be produced from plastic and serves to supply water to another element of the sanitary installation, such as a pipe fitting. It typically has a diameter of 16 or 12 mm.

In order to mount and install the device described hereinabove, first of all a through-passage 6 must be made in the wall 4. This passage can be produced using a rotating tool such as a crown saw and its dimensions, in this case its diameter, are designed to be slightly greater than those of the housings 1 or 2.

The connecting element 3 is then introduced into the housing 1 and is fixed in the housing as illustrated in FIG. 4.

The free end 50 of the pipe 5 is then pulled out by passing it through the passage 6 from the rear side of the wall 4 to the front side. The free end 50 of the pipe 5 can then be connected to the rear part 30 of the connecting element. This connection is easy to carry out since there is no space restriction for the installer on the front side of the wall which corresponds to a room of the dwelling in which the pipe fitting, for example, is provided.

As indicated hereinabove with reference to FIG. 3, this connection between the pipe and the rear part 30 is, preferably, produced using the teachings of the document EP-1 533 556. This is because a connection of this type mechanically fastens the two elements irreversibly together, thus eliminating any risk of a leak.

The next step consists in introducing the housing 1 into the passage 6 from the front side of the wall 4. The bottom 11 of the housing is introduced first into the passage, such that its open side 12 opens onto the front side 41 of the wall 4. In the example illustrated in FIG. 5, where the housing 1 has an annular collar 13, the housing 1 is introduced into the passage 6 until the collar 13 presses against the front side 41. The housing is introduced easily through the passage 6, since the installer performs the operation from the front side of the wall. It is also simplified on account of the housing being produced in one piece.

The housing is then fixed on the front side 41 by appropriate fixing means passing through the openings in the collar 13. The housing is then in the position illustrated in FIG. 5. The above explanations show that the housing is fixed only on the front side. Other fixing means, in particular on the rear side 42 of the wall, become unnecessary. In any case, the rear side cannot be accessed by the user.

A housing as illustrated in FIG. 2 will be fixed by sealing.

The order of these steps can be modified. Thus, the housing may be fixed on the wall 4 before the pipe is connected to the connecting element and the connecting element is fixed in the housing.

Preferably, the open side 12 of the housing 1 is closed by a cover 7 which will be described with reference to FIG. 6. This cover has a precut line 71. By virtue of this line 71, a simple finger pressure opens up a passage 72 for the front part 31 of the connecting element.

The cover 7 can then be fixed on the housing 1 by virtue of the fixing means passing through the openings 73*a* and 73*b* in the cover and in the openings 19*a* and 19*b* of the protruding elements 16*a* and 16*b* of the housing 1.

A layer 43 of cement glue can then be deposited on the front side 41 of the wall 4 and earthenware or floor tiles 44 then adhesively bonded to this layer 43.

The length of the front part 31 of the connecting element is selected such that it protrudes slightly beyond the earthenware tiles 44 after they have been fixed on the wall 4.

Figure 6:
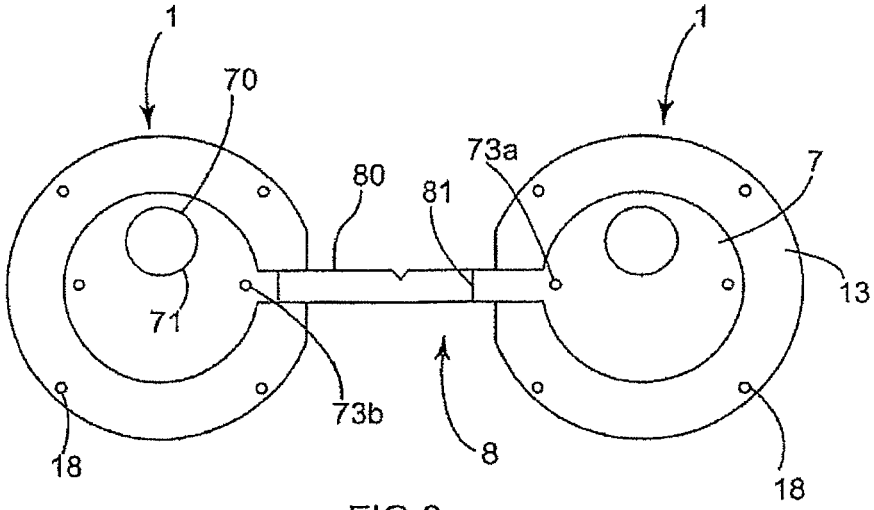
FIG. 6 is a top view of two housings in accordance with FIG. 1 which are connected by a template for a device for mounting and connecting two pipes.

FIG. 6 illustrates the housings of a mounting and connecting device according to the invention intended for two pipes which are still located behind a wall.

In this case, an additional condition is to respect the spacing between two inlets of an element of the sanitary installation, for example a pipe fitting common to two faucets.

For this purpose, a template 8 is associated with the two housings 1 already described with reference to FIG. 1.

This template comprises the covers 7 associated with each housing and already described with reference to FIG. 5, and also a rod 80 connecting these two covers 7.

Preferably, the rod 80 is slightly raised with respect to the covers 7 in order to be able to position a leveling tool.

The length of this rod 80 is selected such that the distance between the passages 72 defined by the precut lines 71 corresponds to the spacing desired between the two inlets of the common pipe fitting.

The template is used in the following manner.

It is held against the front side 41 of the wall 4 illustrated in FIG. 5 at the height desired for the pipes to emerge. The regions for drilling the passages 6 and openings 72 are then marked on the front side of the wall with the aid of the template 8.

The identification on the covers 7 of the passages 72 through which the connecting elements will emerge enables the user to position these openings 72 as well as possible with respect to the earthenware tiles. This is because it is advantageous to position these openings 72 at joints between the tiles in order to avoid the tricky operation of drilling through these tiles.

With this particular device, the method is then implemented as has already been described with reference to FIG. 5.

When the covers need to be placed on the housings, the rod 80 is broken at lines of weakness 81, thereby releasing the two covers. The cutout 17 provided on the collar 13 of the housing makes it possible to position the cover on the housing 1.

Furthermore, the device according to the invention allows the connection of a pipe fitting and also the connection of a radiator. In the latter case, two housings are used, with one housing serving as the inlet for the water coming from a boiler and the other serving as the outlet for the water once it has flowed through the radiator.

The device and the method according to the invention can be used not only for pipes provided behind a vertical wall but also for pipes passing under a floor. Thus, for heating systems, a radiator can be connected at a wall, such as for a pipe fitting, or through the floor, the device according to the invention then being, for example, fixed to the mesh of the concrete slab.

Within the scope of the invention, the term wall could designate either a vertical wall, such as a partition, or a horizontal wall, such as a floor.

The method and the device according to the invention are simpler to implement, require a minimum number of tools and are thus open to nonprofessionals. In practice, they allow the distribution of water within a dwelling in the same way as electricity is distributed.

The reference signs following the technical features in the claims are only intended to make it easier to read the latter and are not intended to limit the scope thereof.

The invention claimed is:

1. A device for mounting and connecting at least one sanitary installation pipe (5) provided behind a wall (4), comprising:

at least one connecting element (3) having a rear part (30) intended to be connected to a free end of the pipe and a front part (31) configured to connect to another element of the sanitary installation, provided in front of the wall, and at least one housing (1, 2) made in one piece which has an opening for a free end of the pipe to pass through, characterized in that said housing (1, 2), cylindrical, further has a bottom (11), a wall (10), and an open side (12) opposite the bottom through which a connecting element (3) can be introduced, an opening (15) being provided in the wall (10), and the dimensions of said housing (1, 2) being lower than the dimensions of a passage (6) provided through the wall (4) so that said housing may be introduced into said passage (6) from the front of the wall and greater than the dimensions of the connecting element (3) so that said element may be completely housed in the housing, after its insertion by the open side (12) of said housing.

2. The device as claimed in claim 1, characterized in that said at least one housing (1) comprises, on the open side (12), a collar (13) intended to be pressed against the front side (41) of said wall.

3. The device as claimed in claim 2, characterized in that the housing comprises means (18) for fixing the housing (1) on the front side of the wall, the fixing means provided on said collar.

4. The device as claimed in claim 1, characterized in that the housing (1, 2) has a bottom (11) on which sockets (14*a*, 14*b*) for fixing the connecting element (3) are provided.

5. The device as claimed in claim 1, characterized in that the rear part (30) of the connecting element (3) has a rigid tubular end fitting (300), the free end (50) of the pipe (5) being fitted on said end fitting (300) by means of a metal ring attached to the pipe (5) and of a nut screwed onto said end fitting.

6. The device as claimed in claim 5, characterized in that said ring is machined in order to promote the flow of the material toward the inside of the ring when the nut is screwed onto the end fitting.

7. The device as claimed in claim 1, characterized in that said device further comprises a cover (7) for closing the open side (12) of the housing (1, 2).

8. The device as claimed in claim 7, characterized in that the cover (7) has a precut part (71) for the front part (31) of the connecting element (3) to pass through.

9. The device as claimed in claim 7, characterized in that the cover has means (73*a*, 73*b*) for fixing it to the housing (1, 2).

10. The device as claimed in claim 1, characterized in that, for mounting and connecting two pipes, said device comprises a template (8) formed by two covers (7) connected by a rod (80), the length of the rod corresponding to a spacing between two inlets for said two pipes.

11. A method for mounting and connecting at least one sanitary installation pipe provided behind a wall (4), comprising the following steps:

(a) providing at least one through-passage (6) in said wall (4);

(b) introducing one connecting element (3) into a cylindrical, made in one piece, housing (1, 2) through an open side (12) of said housing, the dimensions of the housing (1, 2) being greater than the dimensions of said element (3), the housing further comprising a bottom opposite the open side and a wall;

(c) passing the free end (50) of the pipe (5) through an opening (15) provided in the wall of the housing (1, 2);

(d) connecting the free end (50) of the pipe (5) and the rear part (30) of the connecting element (3);

(e) introducing said housing (1, 2) into said passage (6) from the front of the wall such that said open side (12) opens onto the front side (41) of the wall (4); and (f) fixing the housing (1, 2) on the front side (41) of the wall (4).

12. The method as claimed in claim 11, which further comprises fixing the connecting element (3) in the housing (1, 2) after step (d).

13. The method as claimed in claim 11, which further comprises, before step (f), pressing the housing (1, 2) against the front side (41) of the partition (4) by way of a collar (13) provided on its open side (12).

14. The method as claimed in claim 13, in which step (f) is carried out with fixing means (18) provided on said collar (13).

15. The method as claimed in claim 11, in which step (d) further comprises attaching a metal ring around the free end (50) of the pipe (5) and in screwing a nut onto a rigid tubular end fitting (300) provided on the rear part (30) of the connecting element (3), the screwing operation causing axial compression of the ring and mechanically fastening the ring irreversibly to the duct.

16. The method as claimed in claim 11, which further comprises, after step (f), closing the open side (12) of the housing (1, 2) with a cover (7) having a passage (72) for the front part (31) of the connecting element (3).

17. The method as claimed in claim 11, which further comprises, for mounting and connecting two pipes, defining a spacing between two of said passages (6) in the wall (4) using a template (8).

* * * * *